United States Patent [19]

Gaston

[11] Patent Number: 4,615,281

[45] Date of Patent: Oct. 7, 1986

[54] KEY SAFE

[76] Inventor: Robert E. Gaston, 21675 Bentler, Southfield, Mich.

[21] Appl. No.: 769,111

[22] Filed: Aug. 26, 1985

[51] Int. Cl.[4] ..... E05G 1/00; E06B 7/28

[52] U.S. Cl. ..... 109/50; 109/46; 109/59 R; 70/63; 70/388; 49/171; 49/379; 49/394

[58] Field of Search ..... 109/50, 45, 46, 53, 109/54, 59 R, 59 T, 51, 52; 70/63, 388, 444, 459; 49/394, 169, 171, 379

[56] References Cited

U.S. PATENT DOCUMENTS

| | | | |
|---|---|---|---|
| 2,253,332 | 8/1941 | Jackson | 70/57 |
| 2,732,816 | 1/1956 | Stein | 109/59 |
| 2,737,910 | 8/1956 | Shuman | 109/47 |
| 3,084,008 | 4/1963 | Mallett | 70/63 |
| 3,411,046 | 11/1968 | Swannick | 70/277 |
| 3,795,417 | 3/1974 | Cohen | 232/15 |
| 4,296,617 | 10/1981 | Campagna | 70/63 |

FOREIGN PATENT DOCUMENTS

| | | | |
|---|---|---|---|
| 698724 | 11/1940 | Fed. Rep. of Germany | 109/46 |
| 9420 | of 1901 | United Kingdom | 109/59 |
| 299213 | 10/1928 | United Kingdom | 49/171 |

*Primary Examiner*—William F. Pate, III
*Assistant Examiner*—Caroline Dennison
*Attorney, Agent, or Firm*—Cullen, Sloman, Cantor, Grauer, Scott & Rutherford

[57] ABSTRACT

In combination with a building door, there is provided a key safe for a door key comprising an open ended housing secured within and projecting through the door. A safe door is hinged to and closes one end of the housing and has a retractable latch bar engageable with the building door to lock the safe door. A combination lock on the safe door includes a normally open printed circuit connected to a power source. A solenoid is connected to the circuit and includes a plunger connected to the latch bar. A tamper proof key tray is nested within the housing and normally spring biased for ejection inwardly of the building door. A first detent assembly is interposed between the safe door and tray so that any forceful opening of the safe door disengages the detent assembly.

13 Claims, 2 Drawing Figures

KEY SAFE

BACKGROUND OF THE INVENTION

Heretofore in many situations, joggers and others who prefer not to carry the door key wth them, would rather leave it behind in a safe storage area, if one can be found, which is really safe. Often times joggers and others by removing the key from the premises or carrying it with them, misplace or lose the key making access to the locked building door or house door difficult and often times expensive.

Heretofore there have been efforts in providing a means of storing the key within a door safe or housing and wherein heretofore various involved devices have been employed for obtaining access to the key safe within the door. Heretofore in key safes of this nature, the safe door may be forcefully opened permitting access and removal of the key for unauthorized entry.

THE PRIOR ART

Examples of prior art constructions directed to key safes and related combination locks are shown in one or more of the following U.S. Pat. Nos.:

| NAME | NUMBER | TITLE |
|---|---|---|
| Mallett | 3,084,008 | Key Safe with Key |
| Swannick | 3,411,046 | Electronic Combination Lock |
| Cahan | 3,742,741 | Key Receptacle with Key |
| Barrett et al | 3,800,576 | Combination Lock for Key Vault |
| Law | 3,934,434 | Combination Key Safe |
| Campagna | 4,296,617 | Lockable Key Holding Receptacle |
| Jackson | 2,253,332 | Key Holder and Protector |
| Shuman | 2,737,910 | Catapult Cartridge Safe |

SUMMARY OF THE INVENTION

It is an important feature of the present invention to provide an improved key safe for a door wherein an open ended housing is projected through and secured to a door storing a key, and includes a safe door on one end flush with the door exterior and including a normally closed retractable latch bar engageable with the building door. Further included is a combination lock upon the safe door including an electrical circuit and power source connected to a solenoid having a spring biased plunger connected to the latch bar for unlocking the door.

A further feature includes a key safe housing including inner and outer telescoping sections to accomodate to different door thicknesses and wherein an outturned right angular stop flange is mounted upon one of the sections to retainingly engage the inner surface of the door.

A further feature contemplates a combination lock incorporating push buttons by which the correct selection of push buttons is adapted to close an electrical circuit, such as a printed circuit, connected to a power source, and wherein a solenoid is connected to the circuit and includes a spring biased plunger connected to a latch bar.

Another feature includes the storage battery nested within the door or within the safe housing as the power source for said solenoid.

It is a further object of the present invention to provide a tamper proof key storage tray upon the interior of the housing which is normally biased for ejecting movement out of the housing upon the interior of the door. Cooperating first detent means normally interconnect the safe door and tray whereby unauthorized forcing of the door open with the door latched, the detent means are disconnected and the key tray is automatically projected into the interior of the building dumping the key therefrom.

Another feature is to provide a normally disconnected second detent assembly between the spring biased key tray within the housing and the latch. Upon normal retraction of the latch bar to unlock the safe door, the second detent means are engaged for retaining the key tray against dislodgment from said housing.

These and other features and objects will be seen from the following Specification and claims in conjunction with the appended drawing.

THE DRAWING

Figure 1:
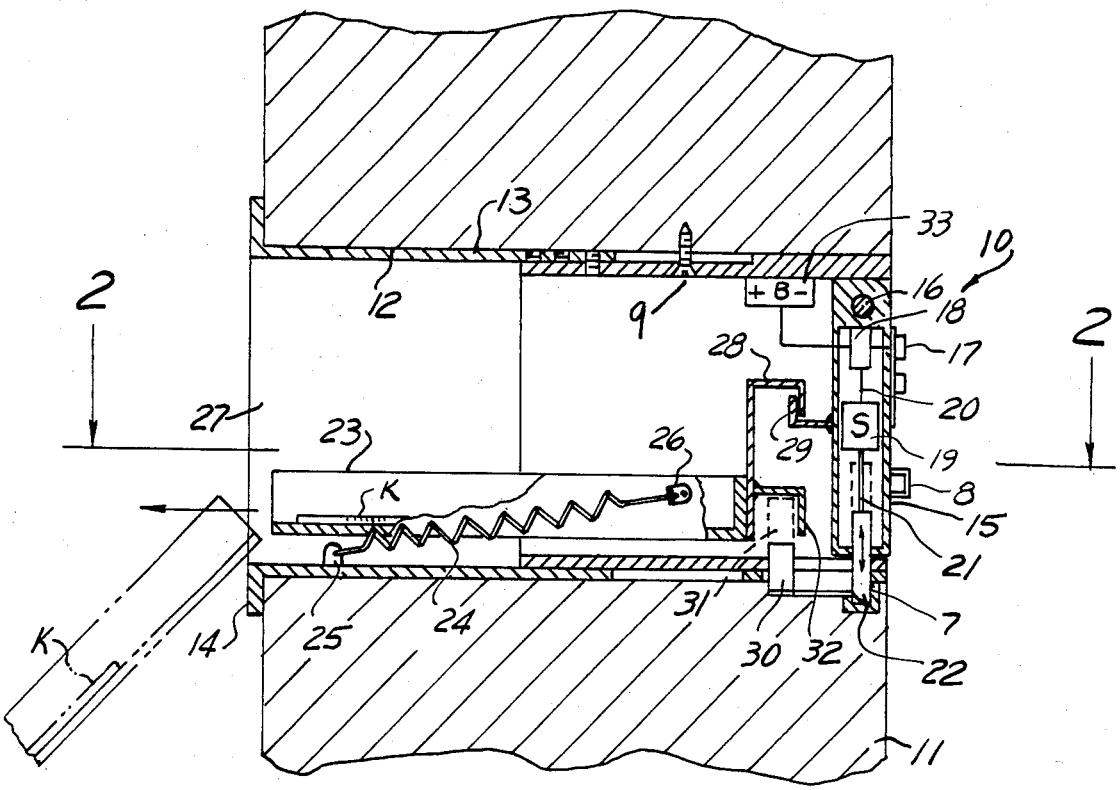
FIG. 1 is a fragmentary side elevational section of the present key safe nested within a building door, fragmentarily shown.
Figure 2:
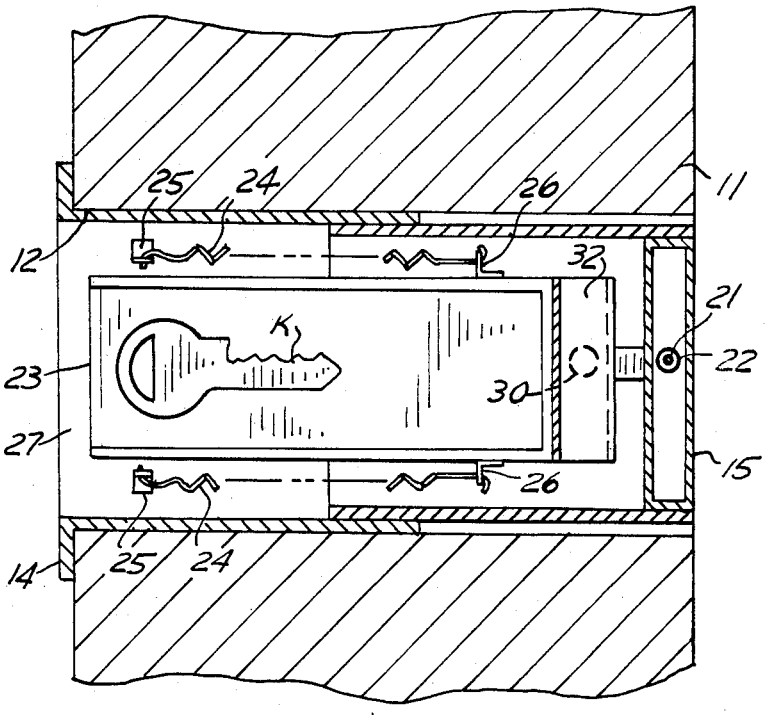
FIG. 2 is a plan section taken in the direction of arrows 2—2 of FIG. 1.

It will be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

Referring to the drawing, a key safe for doors is generally indicated at 10, mounted within and upon a building door 11, fragmentarily showns, which could be the door of a house or commercial structure, wherein the door has inner and outer sides and wherein the key safe is arranged adjacent the outer side of the door.

A transverse aperture 12 is formed through the door, preferably rectangular in cross-section, and projected therethrough is a telescoping sectional housing 13 with inner and outer sections adjusted to the width of the door and secured thereto by a plurality of fasteners 9.

The inner section of said housing includes a right angular outturned flange 14, which may be peripheral, and which is adapted to retainingly engage the interior surface of the door, FIG. 1.

Said housing is open ended, with the opening 27 on the inner section of said housing in communication with the interior of the door or building. Positioned within the other open end of the outer section of said housing there is provided a safe door 15 which normally closes off said housing and is pivotally mounted thereto by the transverse hinge 16 upon one side thereof.

Combination lock 17, preferably a push button combination lock, FIG. 1, is mounted upon or within the safe door and includes a normally open printed circuit 18, schematically shown, which is in communication with a power source 33. Said source may be a storage battery, such as a two volt battery positioned upon the interior of said housing or within door 11.

The detail and construction of combination lock 17 is not shown or described, however, constructions of this type are shown in one or more of the following U.S. Pat. Nos.; 3,411,046, 3,800,576, 3,934,434. The disclosure in any one of these patents is incorporated herein only to the extent of an understanding as to the structure and function of a combination lock and particularly a push button combination lock.

An electric solenoid 19 is schematically shown disposed within safe door 15 and connected by lead 20 to normally open printed circuit 18. Said solenoid includes a spring biased plunger 21 which is aligned with and connected to the normally closed retractable latch bar 22.

In the drawing, the latch bar is shown interlocked with the conventional strike plate 7 mounted upon a portion of building door 11 adjacent said latch bar.

In normal operation upon pushing of the proper combination of buttons of the push button combination lock 17, the normally open printed circuit 18 is closed and electrical power from the source 33 is delivered through lead 20 to solenoid 19 causing a retraction of its plunger 21 and the connected latch bar 22 disengaging strike plate 7. Manual application to handle 8 permits the safe door to be swung open for access to a door key K nested within said housing.

The present key safe for doors has a tamper proof feature which includes an elongated rectangular key tray 23 open at it opposite ends normally storing key K. The tray is mounted upon and within housing 13 the position shown in FIG. 1.

A pair of coil springs 24, sometimes referred to as spring means, are arranged upon opposite sides of tray 23 and at their one ends are anchored to housing 13 at 25 and at their other ends anchored to forward portions of the tray at 26. Therefore, the key tray is normally biased for ejection inwardly of the door such as to the dash line position shown for dumping the key upon the interior of the door. This occurs if someone forces open the safe door 15 without properly operating the combination lock and retracting latch bar 22.

A suitable detent means assembly is normally interposed between the tray and the safe door which is sufficiently engaged as to retain the key tray within housing 13 against the action of tension springs 24. This detent assembly, sometimes referred to as first detent means, includes reverse downturned tray detent 28, extending from the tray and the upturned door catch 29 connected to and projecting inwardly of the door 15 normally in an interference position with respect to tray detent 28.

Accordingly, should the door 15 be forced open without proper retraction of the latch bar 22 utilizing the combination lock 17, then in that case, the door catch 29 is disengaged from tray detent 28 and the key tray 23 is automatically ejected inwardly of the door such as to the dash line position shown. The key drops by gravity onto the floor upon the door interior. This thus prevents access to the key by anyone who has jimmied or otherwise forced open safe door 15.

In normal operation of the safe door 15 application of the proper push buttons of the combination lock 17 closes the circuit 18, energizes solenoid 19 to retract the latch bar 22. A means must be provided for restraining the key tray against accidental dislodgment or projection to the interior of door 11. For this purpose, there is provided a normally disconnected second detent means, FIG. 1, wherein upon proper retraction of latch bar 22 with respect to door strike 7, the second detent means will be moved to the dash line position shown so as to be in retaining engagement with respect to the downturned tray catch 32. Said catch is connected to and projects rearwardly of tray 23.

The second detent means includes the tray catch 32 and tray stop 30 which is projected inwardly of and connected to latch bar 22. In the position shown in FIG. 1 with the latch bar in a locked position, the tray stop 30 is normally not blocking or engaged with the tray catch 32. Accordingly, only the first detent means 28, 29 are employable, should the safe door 15 be forced open.

In the event that the push button lock 17 is properly operated to retract latch bar 22 disengaging strike plate 7 on the door, such upward movement of latch bar 22 causes a corresponding upward movement of the tray stop 30 to the dash line position 31, fragmentarily shown. This is an interference position with respect to tray catch 32. This thus brings a second detent means 31, 32 into retaining engagement so that the key tray 23 is restrained within the housing by the tray stop 30 when the safe door 15 has been properly unlocked and opened.

While push buttons have been shown for the preferred form of combination lock 17 for normally closing the electrical circuit to the solenoid 19, it is contemplated as equivalent that any other form of combination lock may be employed, which will have the effect of closing the electrical circuit from the power source 33 to solenoid 19.

The combination of said lock may be modified in a conventional manner, by the user at any time.

Said lock may have on it a "low battery" lead light to tell the user it is time to replace the battery.

Having described my invention, reference should now be had to the following claims.

I claim:

1. In combination with a building door having inner and outer sides and a transverse aperture therethrough;

a key safe comprising an open ended housing nested and retained in said aperture and having one open end in registry with said outer side;

a safe door hinged within and normally closing said one open end of said housing flush with said building door;

a normally closed latch bar slidably and reciprocally mounted upon and within said safe door interlocked with a strike plate upon said building door;

a combination lock on said safe door including a normally open printed circuit connected to a power source;

a solenoid within said safe door connected to said circuit and having a spring biased plunger connected to said latch bar;

energization of said solenoid retracting said latch bar permitting opening of the safe door and access to a key for said building door stored within said housing.

2. In the key safe of claim 1, said housing having inner and outer telescoping sections to accomodate different door thicknesses;

and an outturned right angular stop flange at one end of said inner section retainingly engaging said inner side.

3. In the key safe of claim 1, fasteners securing said housing to said building door.

4. In the key safe of claim 1, said lock being a push button combination lock, the correct combination closing said circuit to said solenoid.

5. In the key safe of claim 1, said power source being a storage battery nested within said housing.

6. In the key safe of claim 1, a handle on said safe door.

7. In the key safe of claim 1, an open ended key tray slidably mounted within said housing receiving said key;

spring means interconnecting said tray and housing normally urging said tray through the other open end of said housing;

and first detent means interconnecting said safe door and tray, normally retaining said tray within said housing;

any forceful opening of safe door when latched disconnecting said first detent means, said tray automatically moving inwardly upon the interior of said door, dumping said key.

8. In the key safe of claim 7, said spring means including at least one coil spring at its ends respectively connected to said housing and tray.

9. In the key safe of claim 8, there being a pair of said coil springs upon opposite sides of said tray.

10. In the key safe of claim 7, said tray on inward movement tilting angularly downward over the edge of said housing, the key sliding out of said tray.

11. In the key safe of claim 7, said first detent means including a tray detent projecting from one end of said tray;

and a door catch upon and projecting inwardly of said safe door interlocked with said tray detent, any forceful opening of said safe door disconnecting said tray detent and door catch.

12. In the key safe of claim 7, second detent means on said latch bar and tray, being normally disconnected, retration of said latch bar under the control of said solenoid permitting opening of said safe door disconnecting said first latch means and interconnecting said second latch means retaining said tray within said housing.

13. In the key safe of claim 12, said second detent means including a catch projecting from said tray;

and a tray stop inwardly of and connected to said latch bar, normal retraction of said latch bar moving said tray stop into interlocking retaining engagement with said tray catch.

* * * * *